US005195732A

United States Patent [19]

Focke

[11] Patent Number: 5,195,732

[45] Date of Patent: Mar. 23, 1993

[54] APPARATUS FOR THE EXTRACTION OF BLANKS FROM A BLANK MAGAZINE

[75] Inventor: Heinz Focke, Verden, Fed. Rep. of Germany

[73] Assignee: Focke & Co., Verden, Fed. Rep. of Germany

[21] Appl. No.: 734,661

[22] Filed: Jul. 23, 1991

[30] Foreign Application Priority Data

Aug. 1, 1990 [DE] Fed. Rep. of Germany ..... 4024396

[51] Int. Cl.[5] ..... B65H 3/12

[52] U.S. Cl. ..... 271/11; 493/480; 271/14; 271/100; 271/106

[58] Field of Search ..... 271/11, 14, 20, 100, 271/101, 102, 106, 107; 492/313, 315, 316, 317, 480

[56] References Cited

U.S. PATENT DOCUMENTS

| | | | |
|---|---|---|---|
| 754,204 | 3/1904 | Dexter | 271/20 |
| 2,378,306 | 6/1945 | Leonhart | 271/102 |
| 4,369,962 | 1/1983 | Spiro | 271/11 |
| 5,031,892 | 7/1991 | Stieger | 271/14 |

FOREIGN PATENT DOCUMENTS

| | | |
|---|---|---|
| 1060701 | 7/1959 | Fed. Rep. of Germany . |
| 2527448 | 1/1977 | Fed. Rep. of Germany . |
| 4001730 | 7/1990 | Fed. Rep. of Germany . |
| 3905214 | 8/1990 | Fed. Rep. of Germany . |
| 0855897 | 12/1960 | United Kingdom . |

*Primary Examiner*—Bruce M. Kisliuk
*Assistant Examiner*—Jack Lavinder
*Attorney, Agent, or Firm*—Sughrue, Mion, Zinn, Macpeak & Seas

[57] ABSTRACT

For the production of packs from (thin) cardboard, blanks (10) are prefabricated and stored as a blank stack (16) in a blank magazine (17) for processing. An extraction member (20) serves for extracting the individual blanks from the underside of the blank magazine (17) and transports the blanks into a discharge-conveyor plane (21). The extraction member (20) is transportable over a small acute angle as a result of a pivoting movement, in order to move the blanks from the blank stack (16) into the discharge-conveyor plane (21). Furthermore, the extraction member (20) is so designed that, immediately after the discharge-conveyor plane (21) is reached, it can be conveyed into an initial position as a result of sideways movements of holding members (23,24) without being disturbed by the blank (10). In the discharge-conveyor plane (21), the blank (10) is fed to drawer rollers (51, 52 etc) by a pushing-off member (pushing fingers 57,58).

12 Claims, 4 Drawing Sheets

APPARATUS FOR THE EXTRACTION OF BLANKS FROM A BLANK MAGAZINE

BACKGROUND OF THE INVENTION

The invention relates to an apparatus for the extraction of (pack) blanks of (thin) cardboard from the underside of a blank stack, especially from a blank magazine of a packaging machine, by means of least one extraction member on the underside of the blank stack, the extracted blanks being introducible into a discharge-conveyor track extending underneath the blank stack.

In the production of packs from thin cardboard, for example in the production of hinge-lid packs for cigarettes, prefabricated blanks are supplied in stacks to the packaging machine. The blank stacks are introduced into blank magazines and are extracted individually from these on the underside. The blanks then enter the packaging process via the discharge-conveyor track.

With the increasing efficiency of packaging machines, the extraction of the blanks from the blank magazine presents a particular problem. The difficulty is that an individual blank has to be extracted reliably within the shortest possible time and brought into the correct relative position for discharge. The "roll-off" devices often used hitherto in practice can no longer deal with the high performances of modern packaging machines.

SUMMARY OF THE INVENTION

The object on which the invention is based is to provide an apparatus for the extraction of blanks on the underside of a blank magazine, which has a high productive capacity and which allows a reliable careful treatment and positioning of the blanks.

To achieve this object, the apparatus according to the invention is characterized in that the extraction member of the blanks has holding members (suction holders) subjected to a vacuum and each grasping a blank on the free lower side of the latter and as a result of a downward movement transports a grasped blank into the region of the conveyor track.

Accordingly, in the apparatus according to the invention, the extraction member for the blanks is equipped with suction members for grasping the blanks on the free underside. The suction holders are provided with a plurality of suction bores which grasp the blank at selected points, especially adjacent to longitudinal edges of the blank. Mechanical holding members are not needed for extracting the blanks and transporting them away.

According to a further feature of the invention, the extraction member is designed so that, immediately after reaching the discharge-conveyor track for the blank, it is moved out of the region of the latter and returns it to the upper initial or extraction position. Thus, when the extracted blank begins to be transported away, the extraction of the next following blank is already being initiated. This affords a considerable reduction in the cycle times.

In a preferred exemplary embodiment, the extraction member for the blanks consists of two strip-shaped part members—holding arms—which grasp respective strip-shaped lateral regions of the blanks by means of distributed suction bores. In the lower position corresponding to the discharge-conveyor plane of the blanks, the holding arms are moved sideways out of the region of the blank. In point of fact, the holding arms are rotated about a longitudinal axis, so that, because an axis of rotation is positioned off-centre, they come out of the region of the blank to be discharged. During the upward movement of the holding arms in the direction of the underside of the blank magazine, the holding arms are pivoted back into the horizontal position suitable for extracting a blank.

According to the invention, the downward movement of the extraction member together with a blank is likewise a pivoting movement, specifically out of an essentially horizontal upper extraction position into an obliquely directed lower position for the discharge of the extracted blank. The pivoting movement extends over an acute angle, so that only a very brief short stroke movement of the extracted blanks is necessary for transporting them away.

Further features of the invention relate to the design of the extraction member and the drive of this and to the members for discharging extracted blanks.

An exemplary embodiment of the invention is explained in more detail below by means of the drawings. In these:

DESCRIPTION OF A PREFERRED EMBODIMENT

Figure 1:
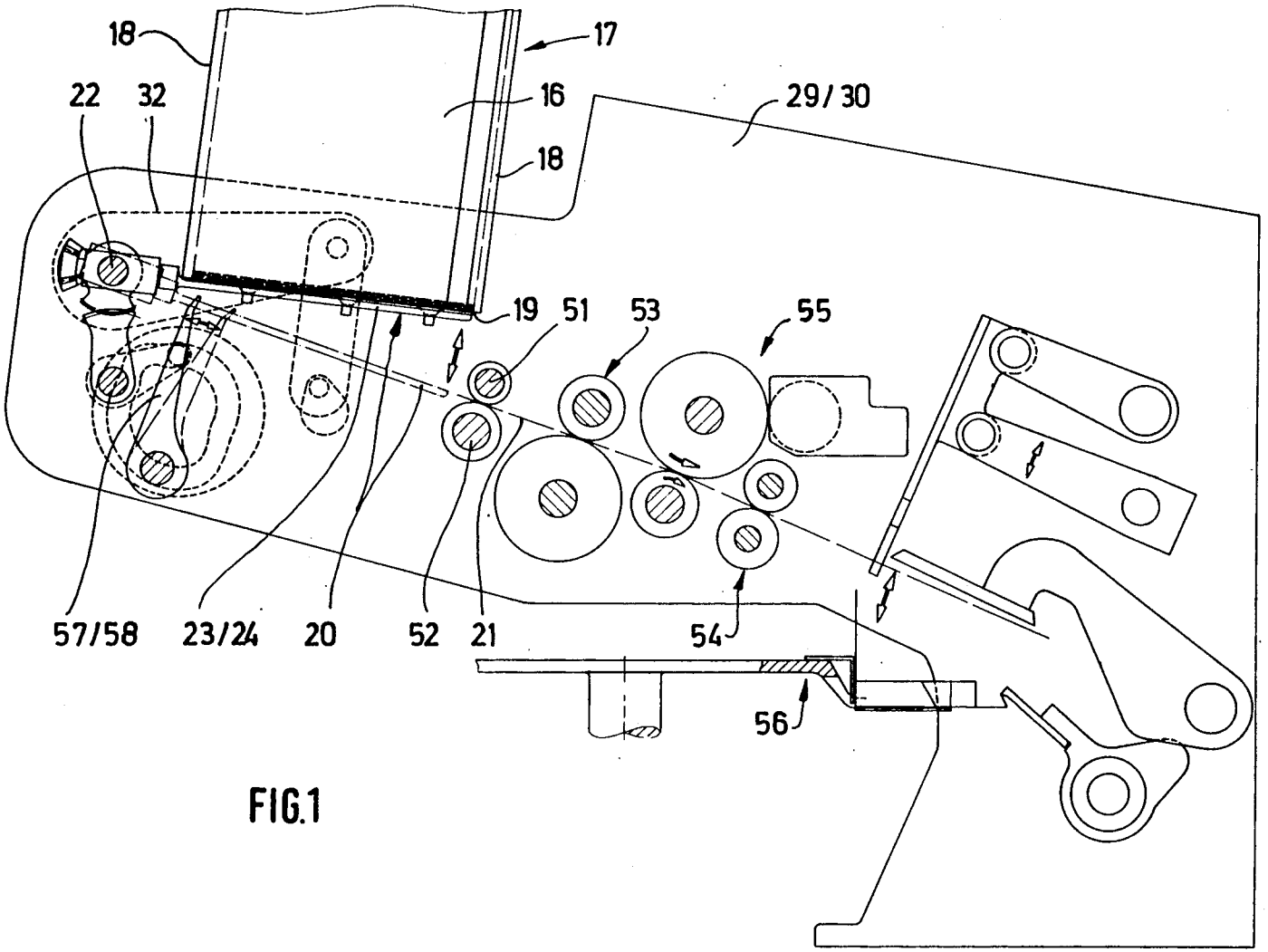
FIG. 1 shows a partially sectional diagrammatic side view of a blank magazine with an extraction apparatus and discharge-conveyor track.

The present exemplary embodiment relates to the treatment of elongate, essentially rectangular blanks 10 made of thin cardboard. These serve particularly for the production of cigarette packs of the hinge-lid type. A blank for such a pack consists of a middle part 11 for forming the front wall, rear wall, bottom wall and lid of the pack. On both sides of the middle part 11 are strip-shaped folding tabs, specifically outer side tabs 12 of narrow side walls of the pack. Furthermore, there are inner side tabs 13 which are located on the inside in the region of the side walls. Trapezoidal outer lid side tabs 14 are present as lateral folding tabs of the lid and a lid corner tab 15 is present as lateral folding tab in the end region of the blank 10.

The blanks 10 are supplied as a relatively large blank stack 16 in a blank magazine 17. This consists essentially of upright lateral magazine walls 18. The blank magazine 17 is open at the top and bottom. In the region of a lower extraction orifice 19, small projections or noses are attached (not shown) to the magazine walls 18 and hold the blank stack 16 in the blank magazine 17.

The blanks 10 are to be extracted successively from the blank magazine 17 at the extraction orifice 19 and transported away for the further packaging process.

The blanks 10 are drawn out of the blank magazine 17 in the region of the extraction orifice 19 by an extraction member 20 and, with a pivoting movement over an acute angle being executed, are brought along a downwardly directed conveying zone into the region of a discharge-conveyor plane 21. The extraction member 20 executes a pivoting movement over an acute angle of less than 30°, specifically out of the here slightly inclined plane of the extraction orifice 19 into the discharge-conveyor plane 21 of more pronounced inclination. For this purpose, the extraction member 20 is pivotable about an axis arranged next to the blank magazine 17, specifically by means of a shaft 22 extending in this axis of rotation.

In the present case, the extraction member 20 consists of two simultaneously and jointly moved holding members 23, 24. These are mounted at a distance from one another on the common shaft 22. The holding members 23, 24 are designed as arms projecting from the shaft 22 on one side, with broadened wings 25 as holding surfaces for the blanks 10.

Arranged distributed in the region of the wings 25 are suction bores 26, 27, 28. These open out on the top side and are connected to a vacuum source via channels and lines (not shown). The extraction member 20 is moved to the underside of the blank stack 16, in such a way that the wings 25 of the holding members 23, 24 bear against the lower blank 10 of the blank stack 16. The suction bores 26, 27, 28 are now subjected to suction air, with the result that the lower blank is grasped and held on the free underside. By means of the above-described movement (pivoting) of the extraction member 20, the lower blank is loosened from the blank magazine 17 and taken up.

In the present exemplary embodiment, the blanks are grasped only in the region of lateral strip-shaped regions. The holding members 23, 24 bear with their wings 25 against the blank 10 only in the region of the lateral folding tabs next to the middle part 11. The suction bores 26, 27, 28 are arranged distributed according to the design of the blank 10 or of the lateral folding tabs, so that the blank 10, when loosened from the blank magazine 17, is taken up correctly. Where the present blank 10 for a hinge-lid pack is concerned, suction bores 26 and 27 engage respectively in the region of the outer and inner side tabs 12, 13. The third suction bore takes effect in the region of the lid side tab 14 or of the adjoining lid corner tab 15.

Figure 2:
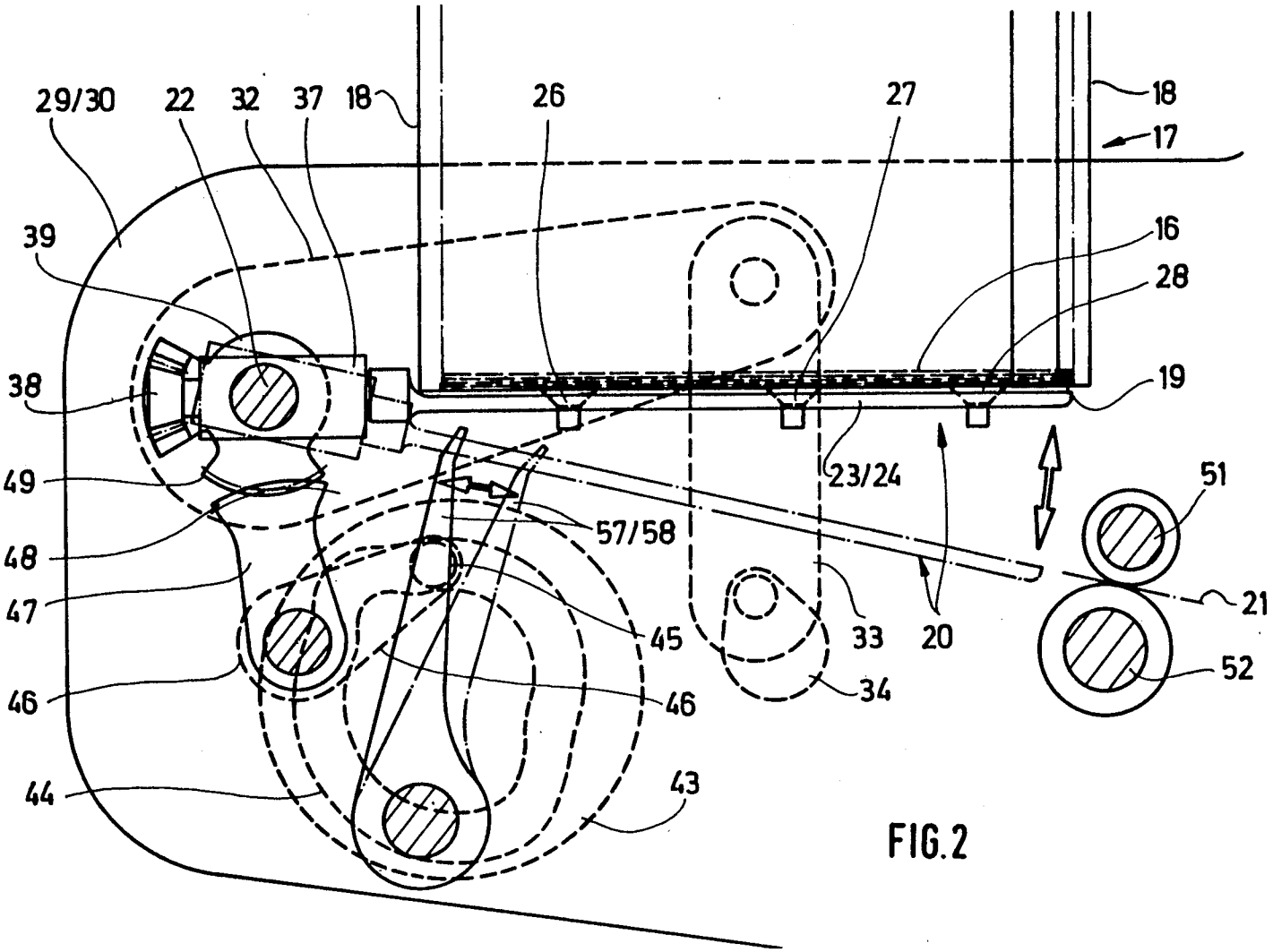
FIG. 2 shows a cutout from the apparatus according to FIG. 1 on an enlarged scale.
Figure 3:
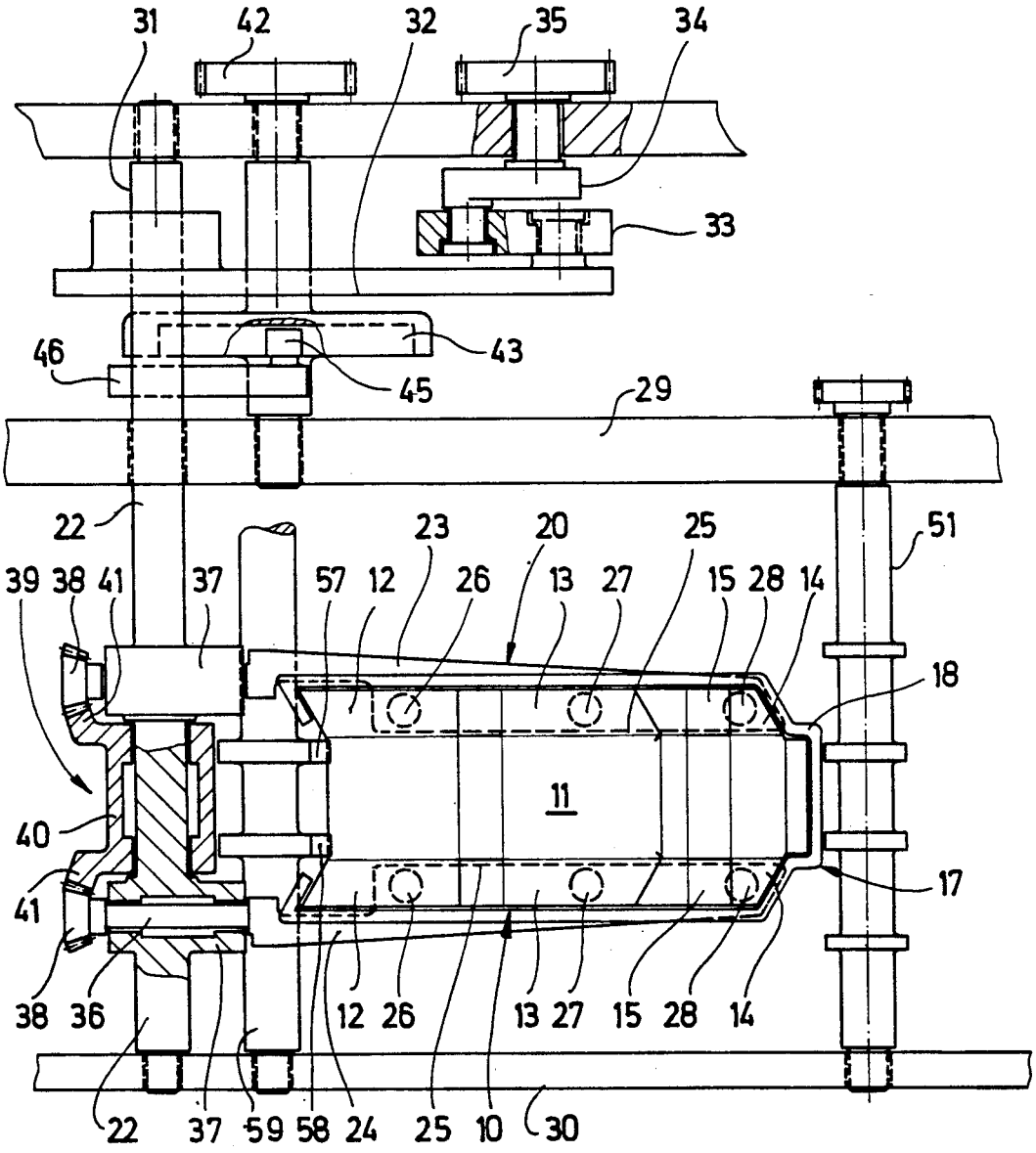
FIG. 3 shows the detail according to FIG. 2 in a plan view, partially in horizontal section.

The two holding members 23, 24 of the extraction member 20 are actuated jointly, in particular out of the approximately horizontal receiving position, represented by unbroken lines in FIG. 2, in the extraction orifice 19 into the oblique discharge position, represented by dot-and-dash lines, and back again. The holding members 23, 24 are moved in this way by means of the common shaft 22. The shaft 22 is mounted rotatably in supporting walls 29, 30. An extension 31 of the shaft 22 is connected to a rotary to-and-fro drive. For this purpose, a pivoting lever 32 is mounted on the shaft 22 and is connected via a link 33 to a drive crank 34. This is driven by a rotating gearwheel 35.

Figure 8:
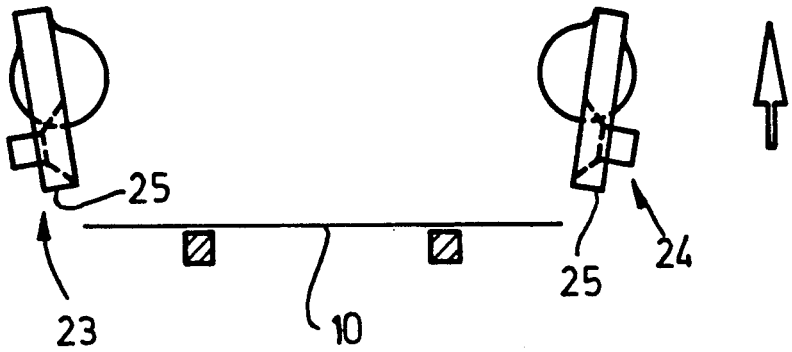

The extraction member 20 is so designed that it is moved in the discharge-conveyor plane 21 of the blanks 10 out of the region of the blank and back into the initial position in the region of the extraction orifice 19. For this purpose, the two holding members 23, 24 are drawn off from the blank 10 by means of an oppositely directed sideways movement and moved upwards. The physical solution for achieving this is that the holding members 23 are pivoted about an axis of rotation arranged off-centre and pointed in the longitudinal direction of the blank. The rotational movement of the holding members 23, 24 causes the wings 25 to pass out of the horizontal holding position into an essentially upright or obliquely directed position (FIG. 8). In this position, the holding members 23, 24 as a whole are located outside the region of the blank 10 and can be moved upwards in the way described, particularly as a result of the pivoting movement.

To execute these rotational movements of the holding members 23, 24, they are mounted rotatably on the side facing away from the blank 10, namely in the region of the shaft 22. A shaft piece 36 at the ends of the holding members 23, 24 is guided in a pivot bearing 37 connected firmly to the shaft 22. This is therefore moved in a pivoting manner together with the shaft 22. Located on the free ends of the shaft pieces 36 coming out of the pivot bearing 37 is a rotary drive. In the present exemplary embodiment, this consists of a gearwheel, particularly a bevel wheel 38 at the end of the respective holding member 23, 24 or shaft piece 36. The two bevel wheels 38 are actuated in a rotating manner by a common drive member 39 mounted on the shaft 22 between the pivot bearings 37.

The drive member 39 comprises a rotary sleeve 40 mounted on the shaft 22. The rotary sleeve 40 is equipped at the ends with toothed quadrants 41 which are each in engagement with a bevel wheel 38. As a result of rotational movements of the rotary sleeve 40, therefore, corresponding rotational movements are transmitted to the bevel wheels 38 and consequently to the holding members 23, 24.

The rotational movement of the holding members 23, 24 about their own longitudinal axis is coordinated with the up-and-down or pivoting movement of the extraction member 20 as a whole. Via a driving gearwheel 42 coupled to the gearwheel 35, a cam disc 43 is moved in rotation. In a control groove 44 of this revolves a tracer roller 45 of an actuating member for the rotary sleeve 40. This is, in point of fact, an actuating lever 46 which is connected to a pivotally driven drive lever 47. This in turn drives the rotary sleeve 40 via a toothed quadrant 48 and a counter-quadrant 49. As a result of the shape of the control groove 44, the drive lever 47 executes pivoting movements which result in a specific intended movement characteristic of the holding members 23, 24 during an extraction operation.

The movement of the holding members 23, 24 which takes place in the present exemplary embodiment is represented diagrammatically in the successive work steps according to FIG. 4 to FIG. 8. The holding members 23, 24 are shown here in an end view. The blank stack 16 is shown only in the lower region. The blank magazine 17 has been omitted for the sake of simplicity.

Figure 4:
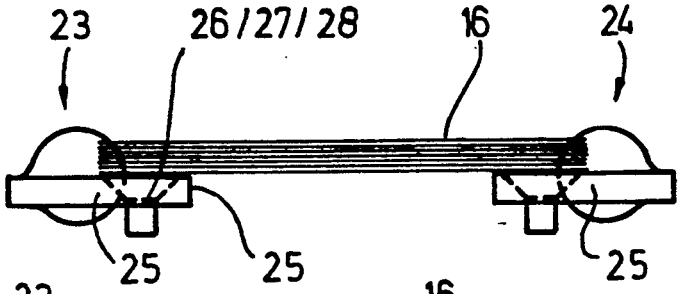
FIG. 4 to FIG. 8 show different positions of an extraction member for blanks in a diagrammatic representation.

FIG. 4 shows the initial position of the holding members 23, 24 during the take-over of the lower blank 10 of the blank stack 16. The wings 25 of the holding members 23, 24 face one another and are directed essentially horizontally. The blank 10 is grasped in the region of its longitudinal sides by means of the suction bores 26 to 28.

As a result of an appropriate pivoting movement of the holding members 23, 24 about their longitudinal axis (rotation of the shaft pieces 36), the wings 25 are first rotated into an upwardly directed oblique position. The lower blank thereby acquires an arched cross-sectional shape. This causes the lower blank 10 to be loosened from the blank stack 16 and extracted from the blank magazine 17.

Figure 5:
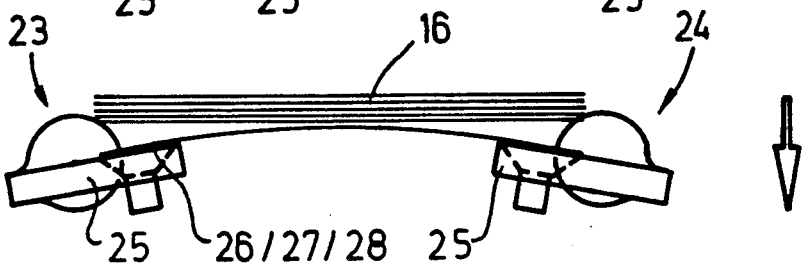

Simultaneously, in the position according to FIG. 5, the downward movement of the extraction member 20 together with the holding members 23, 24 commences, the holding members 23, 24 returning into the initial position with horizontally aligned wings 25 as a result of an oppositely directed rotation.

In this position, the blank 10 is deposited at the bottom in the depositing plane (discharge-conveyor plane 21). This is symbolically represented diagrammatically by supporting sections 50 in FIG. 6 to FIG. 8 for the sake of simplicity.

After the blank 10 has been deposited in the region of the discharge-conveyor plane 21 or on the supporting sections 50, the holding members 23, 24 are once again rotated about the longitudinal axis, in such a way that the wings 25 pivot downwards from the underside of the blank 10 into a virtually upright position. The effective cross-sectional regions of the holding members 23, 24, namely their wings 25, thereby come out of the region of the blank 10. Without touching this, the holding members 23, 24 can now be moved upwards again without interruption, that is to say without delay, into the initial position according to FIG. 4 for the reception of the following blank 10.

During this, the blank deposited in the discharge-conveyor plane 21 is transported away. Special conveying members are provided for this.

The region of the blank 10 located at the front in the direction of transport is grasped by a pair of drawer rollers, with the drawer rollers 51, 52 arranged on both sides of the discharge-conveyor plane 21, and is transported further. These are followed by further driven pairs of drawer rollers 53 and 54. Between these is arranged a glue-coating unit 55. This transfers areas of glue onto the blank 10.

In the course of the further obliquely downward conveyance of the blank 10, the latter passes into a position above a folding turret 56. The folding operation now begins, the details shown in FIG. 4 corresponding to an apparatus according to DE-A-2,440,006.

The blank 10 is deposited in the discharge-conveyor plane 21 at a distance from the (first) drawer rollers 51, 52. The first transport step, in particular the pushing of the front blank region in between the drawer rollers 51, 52, is carried out by a pusher. In the present case, this consists of two pushing fingers 57, 58 which are moved to pivot to and fro. The pushing fingers 57, 58 grasp the blank on the side at the rear in the direction of transport and move it in the discharge-conveyor plane 21 until it is received by the drawer rollers 51, 52. The end positions of the pushing fingers 57, 58 are represented in FIG. 2 by unbroken and dot-and-dash lines.

Figure 6:
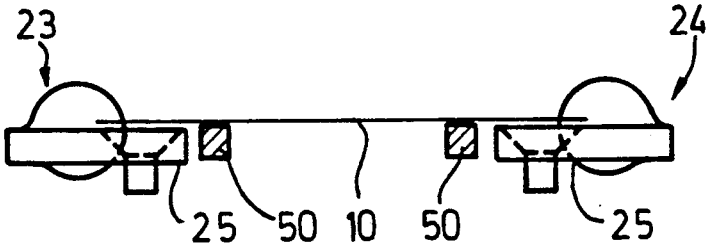
Figure 7:
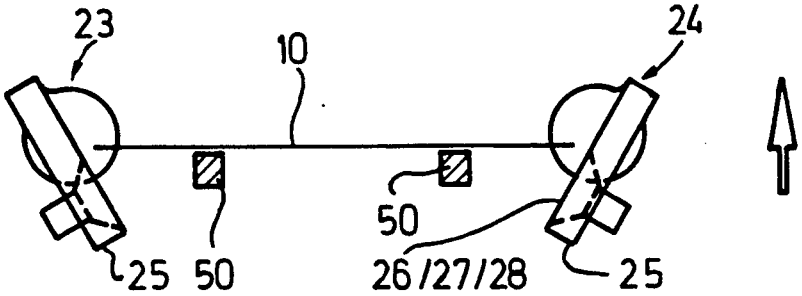

The two pushing fingers 57, 58 are arranged on a common pusher shaft 59. This is driven in synchronism with the extraction member 20. Coordination takes place in such a way that, immediately after the discharge-conveyor plane 21 is reached, the pushing of the blank 10 off the holding members 23, 24 or the wings 25 commences while these are still in the horizontal supporting position (FIG. 6). When the wings 25 come loose from the blank 10 as a result of the pivoting of the holding members 23, 24, this has already been grasped by the drawer rollers 51, 52. The pushing fingers 57, 58 can be moved between the holding members 23, 24.

What is claimed is:

1. Apparatus for the extraction of pack blanks of thin cardboard from an underside of a blank stack located in a blank magazine of a packaging machine, the extracted blanks being introducible into a discharge-conveyor located in a plane (21) extending underneath the blank stack, characterized:

in that, for the extraction of the blanks (10), there is an extraction member (20) comprising holding members (23, 24) which are subjected to a vacuum and by which a blank (10) can be grasped in its lateral regions on a free lower side of the blank, and, as a result of a downward movement of the blank, transported to and deposited on the discharge-conveyor plane (21);

in that said extraction member produces said downward movement;

in that the holding members (23, 24) are elongate and arm-like and in a lower position are rotatable away from the deposited blank (10) in opposite directions and are movable into an upper receiving position for grasping a further blank (10);

in that there are means for rotating and moving said holding members;

in that the holding members (23, 24) have offset bearing faces which engage the blank (10) and which are in the form of plate-like wings (25); and in that said means for rotating causes the holding members (23, 24) respectively to rotate about an axis (36) extending offset relative to the wings (25), in such a way that, as a result of the rotation, the holding members (23, 24) are rotated away from the deposited blank (10) in said opposite directions.

2. Apparatus according to claim 1, characterized in that the holding members (23, 24) are mounted rotatably at first ends thereof by respective shaft pieces (36) located in pivot bearings (37) forming part of a transversely directed shaft (22) for pivotally driving the holding members (23, 24) over an acute angle.

3. Apparatus according to claim 1, characterized in that said extraction member (20) has, on a side facing the blank (10), at least six suction bores (26, 27, 28) arranged in two rows adjacent respective pairs of lateral folding tabs (12, 13, 14) of the blank (10).

4. Apparatus according to claim 3, characterized in that, for grasping blanks (10) of a hinge-lid pack, the suction bores (26, 27, 28) are arranged in the wings (25) in such a way that two outer side tabs (12), two inner side tabs (13) and two lid side tabs (14) can be grasped by respective ones of said suction bores (26, 27, 28).

5. Apparatus according to claim 1, characterized in that the wings (25) are arranged offset relative to the axis of rotation of the holding members (23, 24), in such a way that, as a result of rotation of the wings (25) into an upright plane, the wings are moved completely out of a vicinity of the blank (10).

6. Apparatus for the extraction of pack blanks of thin cardboard from an underside of a blank stack located in a blank magazine of a packaging machine, the extracted blanks being introducible into a discharge-conveyor located in a plane (21) extending underneath the blank stack, characterized:

in that, for the extraction of the blanks (10), there is an extraction member (28) comprising holding members (23, 24) which are subjected to a vacuum and by which a blank (10) can be grasped in its lateral regions on a free lower side of the blank, and, as a result of a downward movement of the blank, transported to and deposited on the discharge-conveyor plane (21);

in that said extraction member produces said downward movement;

in that the holding members (23, 24) are elongate and arm-like and in a lower position are rotatable away from the deposited blank (10) in opposite directions and are movable into an upper receiving position for grasping a further blank (10);

in that there are means for rotating and moving said holding members; and in that, during the extraction of a blank (10) from the blank magazine (17), after the blank has been grasped, it is first brought into an initial arched position as a result of oppositely directed rotational movements of the holding members (23, 24), and then moved downwards and is deposited in the discharge-conveyor plane (21), the holding members (23, 24) being pivotable away from the blank (10) immediately after the discharge-conveyor plane (21) is reached and, as a result of an upward movement, movable back into the initial position.

7. Apparatus for the extraction of pack blanks of thin cardboard from an underside of a blank stack located in a blank magazine of a packaging machine, the extracted blanks being introducible into a discharge-conveyor located in a plane (21) extending underneath the blank stack, characterized:

in that, for the extraction of the blanks (10), there is an extraction member (28) comprising holding members (23, 24) which are subjected to a vacuum and by which a blank (10) can be grasped in its lateral regions on a free lower side of the blank, and, as a result of a downward movement of the blank, transported to and deposited on the discharge-conveyor plane (21);

in that said extraction member produces said downward movement;

in that the holding members (23, 24) are elongate and arm-like and in a lower position are rotatable away from the deposited blank (10) in opposite directions and are movable into an upper receiving position for grasping a further blank (10);

in that there are means for rotating and moving said holding members; and in that the blank (10), after reaching the discharge-conveyor plane (21), can be transported away by a first conveying member in the form of a pusher member with pushing fingers (57, 58) for grasping the blank (10) on a rear side thereof.

8. Apparatus according to claim 7, characterised in that the pushing member (57, 58) is arranged between the holding members (23, 24) of the extraction member (20).

9. Apparatus for the extraction of pack blanks of thin cardboard from an underside of a blank stack located in a blank magazine of a packaging machine, the extracted blanks being introducible into a discharge-conveyor located in a plane (21) extending underneath the blank stack, characterized:

in that, for the extraction of the blanks (10), there is an extraction member (28) comprising holding members (23, 24) which are subjected to a vacuum and by which a blank (10) can be grasped in its lateral regions on a free lower side of the blank, and, as a result of a downward movement of the blank, transported to and deposited on the discharge-conveyor plane (21);

in that said extraction member produces said downward movement;

in that the holding members (23, 24) are elongate and arm-like and in a lower position are rotatable away from the deposited blank (10) in opposite directions and are movable into an upper receiving position for grasping a further blank (10);

in that there are means for rotating and moving said holding members in said opposite directions; and in that the holding members (23, 24) are mounted rotatably at first ends thereof by respective shaft pieces (36) located in pivot bearings (37) forming part of a transversely directed shaft (22) for pivotally driving the holding members (23, 24) over an acute angle.

10. Apparatus according to claim 2 or 4, characterized in that arranged at ends of the shaft pieces (36) are drive members for executing rotational movements about longitudinal axes of the holding members (23, 24), said drive members comprising gearwheels (38) which are in engagement with toothed quadrants (41) of a rotary sleeve (40) mounted on said shaft (22).

11. An apparatus for the extraction of pack blanks (10) of thin cardboard from an underside of blank stack (16) located in a blank magazine (17) of a packaging machine, comprising:

a blank magazine (17);

an extraction member (20) which is provided with a vacuum, for extracting the blanks (10) from the blank magazine (17), and by which the blanks (10) are grasped at a free lower side of the blanks;

wherein the extraction member (20) comprises only two spaced-apart, elongate, arm-like holding members (23, 24) which grasp only lateral portions of each blank (10);

a discharge-conveyor plane (21) located underneath said blank magazine (17);

means for downwardly moving said extraction member to transport a grasped blank out of said blank magazine (17) and into said discharge-conveyor plane;

conveying member means, located in a vicinity of said discharge-conveyor plane (21) and between the elongate and arm-like holding members (23, 24), for discharging the blanks in a conveying direction away from said holding members (23, 24);

means for pivotally moving said extraction member (20) from an upper initial position at said underside of the blank stack (16) in said blank magazine (17) to a lower position in said discharge-conveyor plane (21) which is oblique and downwardly inclined in said conveying direction of the extracted blank; and means for rotating said holding members (23, 24) away from the blank in opposite directions to release the blank (10) in said lower position in said discharge-conveyor plane (21), and for moving said holding members (23, 24) back to said upper position for extracting another blank from said blank magazine (17).

12. An apparatus for the extraction of peak blanks (10) of thin cardboard from an underside of blank stack (16) located in a blank magazine (17) of a packaging machine, comprising:

a blank magazine (17);

an extraction member (20) which is provided with a vacuum, for extracting the blanks (10) from the blank magazine (17), and by which the blanks (10) are grasped at a free lower side of the blanks;

wherein the extraction member (20) comprises only two spaced-apart, elongate, arm-like holding members (23, 24) which grasp only lateral portions of each blank (10);

a discharge-conveyor plane (21) located underneath said blank magazine (17);

means for downwardly moving said extraction member to transport a grasped blank out of said blank magazine (17) and into said discharge-conveyor plane; and conveying member means, located in a vicinity of said discharge-conveyor plane (21) and between the elongate and arm-like holding members (23, 24), for discharging the blanks in a conveying direction away from said holding members (23, 24);

wherein, during the extraction of a blank (10) from the blank magazine (17), after the blank has been grasped, it is first brought into an initial arched position as a result of oppositely directed rotational movements of the holding members (23, 24), and then moved downwards by said extraction member (20) and is deposited in the discharge-conveyor plane (21), the holding members (23, 24) being pivotable away from the blank (10) immediately after the discharge-conveyor plane (21) is reached and, as a result of an upward movement, movable back into the initial position.

* * * * *